United States Patent [19]

Hallenbeck

[11] Patent Number: 5,016,508

[45] Date of Patent: May 21, 1991

[54] MITER GAUGE FOR WOODWORKING MACHINE

[76] Inventor: Edward S. Hallenbeck, 15 Courtenay Cir., Pittsford, N.Y. 14534

[21] Appl. No.: 476,600

[22] Filed: Feb. 7, 1990

[51] Int. Cl.[5] ..... B26D 7/06; B27B 27/08

[52] U.S. Cl. ..... 83/435.001; 83/437; 83/468.003; 83/474; 83/477.002

[58] Field of Search ..... 83/435.1, 432, 421, 83/437, 474, 477.2, 418, 425, 468.3, 468.4

[56] References Cited

U.S. PATENT DOCUMENTS

| | | | |
|---|---|---|---|
| 2,895,515 | 7/1959 | Ende | 83/468.3 X |
| 4,111,409 | 9/1978 | Smith | 83/435.1 X |
| 4,256,000 | 3/1981 | Seidel | 83/468.4 |
| 4,441,394 | 4/1984 | Barsotti | 83/435.1 |
| 4,464,962 | 12/1990 | Myhre | 83/477.2 X |
| 4,494,429 | 1/1985 | Frame | 83/435.1 |
| 4,693,156 | 9/1987 | Olvera | 83/435.1 |
| 4,881,437 | 11/1989 | Macksoud | 83/477.2 |

*Primary Examiner*—Frank T. Yost
*Assistant Examiner*—Kenneth E. Peterson
*Attorney, Agent, or Firm*—Eugene Stephens & Associates

[57] ABSTRACT

A mitering gauge is constructed from three legs of a triangle. Two of the legs have fixed lengths and the third leg is adjustable in length. One of the fixed length legs is formed as a sliding plate and the other fixed length leg is formed as a fence pivotally mounted on the plate for orienting a work piece with respect to a feed direction of a woodworking machine. The third leg is formed as a gauge bar having a plurality of holes spaced in predetermined positions along its length. Different holes in the gauge bar may be aligned with an anchor block mounted on the plate for adjusting the angular orientation of the fence to a number of frequently used mitering angles.

30 Claims, 4 Drawing Sheets

MITER GAUGE FOR WOODWORKING MACHINE

BACKGROUND OF INVENTION

Mitering gauges are attached to woodworking machines for making angled joints between two work pieces. Typically, the joints are formed by cutting the ends of the two work pieces at equal angles. Each of the two ends of the work pieces are separately oriented with respect to a cutting tool at a predetermined angle that is set by the mitering gauge.

For example, it is well known to use a mitering gauge as an attachment to a table saw for orienting a work piece with respect to a rotating saw blade. One edge of the work piece is held against a straightedge or "fence" that is oriented at a predetermined angle with respect to the saw blade. The fence is moved with respect to the saw blade for feeding the work piece into engagement with the saw blade. Different angles may be cut in the ends of wood pieces by angularly adjusting the fence with respect to the direction of the feed movement.

One widely used type of mitering gauge features a fence which is pivotally mounted on a guide rail that slides within a groove (also referred to as a miter slot) formed in a saw table top. The miter slot is parallel to the plane of rotation of the saw blade. One side of the fence functions as a straightedge for aligning a surface or edge of a work piece and the other side supports a gauge that is graduated with a protractor scale. The gauge pivots together with the fence past a reading mark on the guide rail for orienting the fence to a predetermined angle. A thumb screw or similar means tightens the gauge to the guide rail. The work piece is mounted so that one end extends beyond the length of the fence, and the work piece together with the mitering gauge is guided along the miter slot formed in the table top to cut off the end of the work piece at the desired angle with the saw blade.

Although it is possible to set this type of widely used gauge within a tolerance of less than one degree, errors of a magnitude no greater than five minutes may be noticeable in four inch length miter joints. Accordingly, several "trial and error" cuts may be required to set the gauge at an angle that will produce an accurate joint. Such trial and error cuts are time consuming and wasteful of work piece material.

Some of these known mitering gauges also include locating pins for more conveniently setting the gauges to a limited number of widely used angles. The locating pins are attached to the guide rails and are sized to engage one of a number of bores formed in an arcuate peripheral portion of the gauges. The bores are spaced at predetermined angles about the peripheral portion and are aligned with the locating pin by pivoting the gauge to one of the predetermined angles.

The locating pins provide for some improvement in the accuracy and repeatability of the known mitering gauges at a limited number of selected angles; but the gauges are difficult to manufacture, assemble, and maintain within a tolerance that avoids noticeable errors in miter joints. Much of this difficulty is related to a very limited radial distance that separates the fence pivot from the bores in the arcuate portion of the gauge. Even slight errors in the spacing or sizing of the bores lead to considerable angular errors in the orientation of the fence.

Another known type of mitering gauge features a sliding plate for supporting a work piece and for feeding the work piece into a rotating blade. The plate is rectangularly shaped and is sized to cover a portion of a saw table top on one side of the saw blade. A guide rail is attached to the bottom of the plate for sliding within a miter slot formed in the saw table top. One end of an extended length fence is pivotally mounted on a top surface of the plate near the blade for orienting work pieces with respect to the guide rail. A graduated scale is located along a far edge of the plate which can be read against the other end of the fence for orienting the fence to a desired angle. A fastener carried by the fence engages an arcuate slot in the plate centered at the fence pivot for locking the fence to the plate at the desired angle.

Although the scale along the far edge of the plate is located at a substantial distance from the pivot axis, contributing to greater accuracy, considerable skill and experience with the gauge are required to set the gauge within a tolerance that avoids noticeable errors. In addition, a correct setting is not easily repeatable once the gauge has been moved to another position.

Yet another known type of mitering gauge is disclosed in U.S. Pat. No. 3,841,188 to Wiater. The gauge is mounted directly on a saw table top, and a saw blade performs a feed movement within a slot formed through the table top. A fence is divided into two sections by a pivot axis. One section of the fence is mounted on the table top at a fixed angular orientation to the blade slot but may be adjusted through a short distance along the slot. The other section of fence is adjusted angularly about the pivot axis for orienting a work piece with respect to the blade slot. A thumb screw carried by the angularly adjustable fence section engages one of a number of holes tapped in the table top for setting the fence at a fixed angular orientation. Since the one fence section can be adjusted along the slot, the angularly adjustable fence section can be set through a continuum of angles even though only a limited number of tapped holes are provided for maintaining the angularly adjustable fence section in a fixed orientation. However, the ability to adjust the one fence section along the slot requires that trial and error efforts be used to set the angularly adjustable fence section to a desired angle.

SUMMARY OF THE INVENTION

My invention overcomes several of the drawbacks of the prior art by providing a new mitering gauge that may be used with virtually foolproof accuracy for making miter joints in work pieces. In particular, my new mitering gauge may be set to required accuracy without any trial and error cuts in work pieces. Further, my new mitering gauge is intended to be easy to use, to produce repeatable results, and to be economical to manufacture.

My new mitering gauge is arranged to define three legs of a triangle. Two of the legs have fixed lengths, and the third leg is adjustable to a number of predetermined lengths. One of the fixed length legs is oriented at a fixed angle to the feed direction of a woodworking machine, and an angle between the two fixed length legs may be controlled by adjusting the length of the third leg. Accordingly, an angular orientation of one of the fixed length legs with respect to the feed direction of the machine may be controlled by connecting the fixed length legs with the third leg at one of a number of predetermined lengths.

The three legs of the triangle are connected by three axes or vertices which together with the adjustable length leg enable the triangle to assume different shapes. One of the fixed length legs is formed as a fence that may be pivoted about one of the axes for changing the orientation of the fence with respect to the feed direction of the wood-working machine. The other fixed length leg is defined between the just-mentioned pivot axis and a second axis that may be formed in an anchor block. The two axes are mounted in a fixed orientation to the feed direction of the machine and define the fixed length leg between them as a permanent base of the triangle. The second axis may be positioned slightly offset from a line passing through the pivot axis perpendicular to the feed direction. The amount of offset may be selected so that when the fence is oriented into contact with the anchor block or other form of stop defining a rest position, the fence extends exactly perpendicular to the feed direction. In other words, the base of the triangle is inclined slightly from perpendicular to the feed direction to provide adequate clearance for the fence to assume the perpendicular orientation.

The adjustable length leg is defined by a gauge bar that connects the fence to the anchor block. One end of the gauge bar is connected to the fence about a third axis that is formed in the fence at a location remote from the pivot axis. A clamp screw having a portion of its length formed as a locating pin may be used to align a first hole formed in one end region of the gauge bar with a similarly sized bore formed in the fence. A series of additional holes, formed along the length of the gauge bar, may be aligned with a similarly sized bore formed in the anchor block. A locating pin portion of a second clamp screw may be used to align one of the additional holes in the gauge bar with the bore formed in the anchor block. The holes are accurately spaced along the length of the gauge bar so that the fence may be positioned at a number of frequently used angles. For example, the holes may be spaced so that miter joints associated with a range of between three and twelve sided geometric figures may be cut in work pieces.

My novel mitering gauge also includes a sliding plate for feeding a work piece into a cutting blade. A guide rail may be attached to its bottom surface which slides within the standard miter slot of a machine table top. The plate also provides a support for the pivot axis and anchor block which define between them the fixed length leg that forms the base of the triangle.

According to one version of my invention, the plate may also be arranged to support a work piece. The plate may be sized to cover a portion of the machine table top on one side of the saw blade and may also include an arcuate slot centered about the first pivot axis which provides clearance for clamping the remote end of the fence and the gauge bar to the plate. For example, the clamp screw connecting the fence and gauge bar may include a threaded portion which extends through the slot into engagement with a similarly threaded clamping block.

According to another version of my invention, the work piece and fence rest directly on the machine table top. However, a portion of the bottom surface of the fence is cut away to provide clearance for pivoting the fence over a portion of the sliding plate. An adjustable stop may also be mounted on the plate which relieves the anchor block from withstanding shocks associated with returning the fence to its resting position.

My novel mitering gauge may be easily set to any one of a number of predetermined angles by simple adjustments that may be made with two clamp screws. The clamp screw attached to the anchor block may be removed and the other clamp screw may be loosened to enable the fence to be pivoted to a desired position aligning another of the holes in the gauge bar to the bore formed in the anchor block. The removed clamp screw may then be replaced in the anchor block and both clamp screws may be tightened in place to fix the fence to the sliding plate at the desired angular position.

Since the gauge bar is located at a considerable distance from the first pivot axis about which the fence is adjusted, it is only necessary to locate the holes in the gauge bar to within ordinary machining tolerances to provide angular accuracies of the gauge that are well within the tolerance of any noticeable errors in miter joints. For example, if the locations of all of the bores and holes which mount the gauge bar are manufactured to within an accuracy of plus or minus 0.001 inches, the maximum cumulative error of the gauge for angularly orienting work pieces is expected to be within two minutes of angular measure. Such accuracy is well beyond the usual accuracies of prior mitering gauges yet may be obtained with my gauge without any special skill or practice required.

DRAWINGS

DETAILED DESCRIPTION

Figure 1:
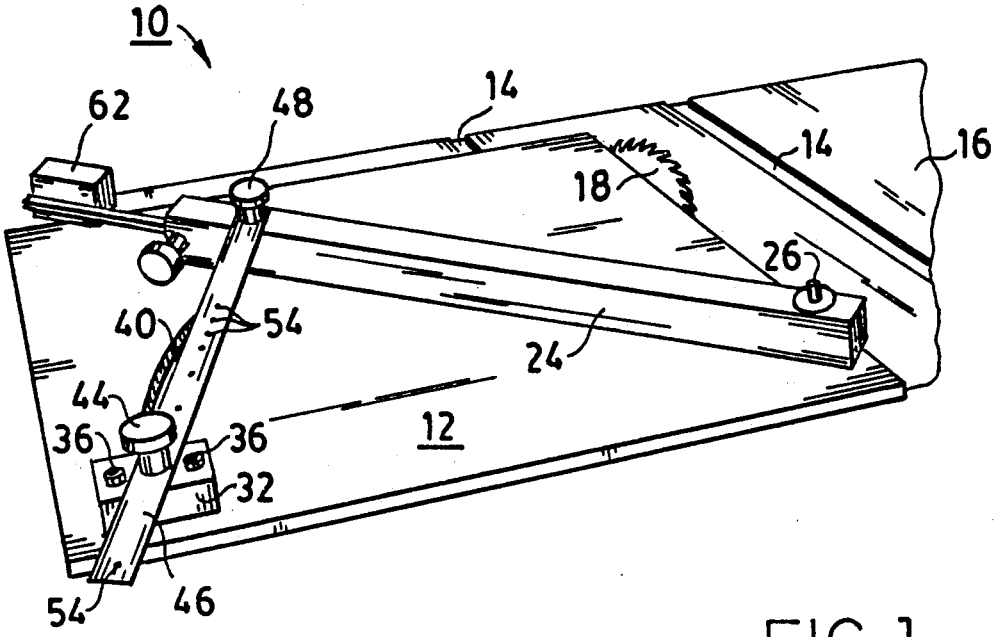
FIG. 1 is a view from an operator's perspective of one embodiment of my novel mitering gauge mounted on a table top of a conventional table saw.
Figure 2:
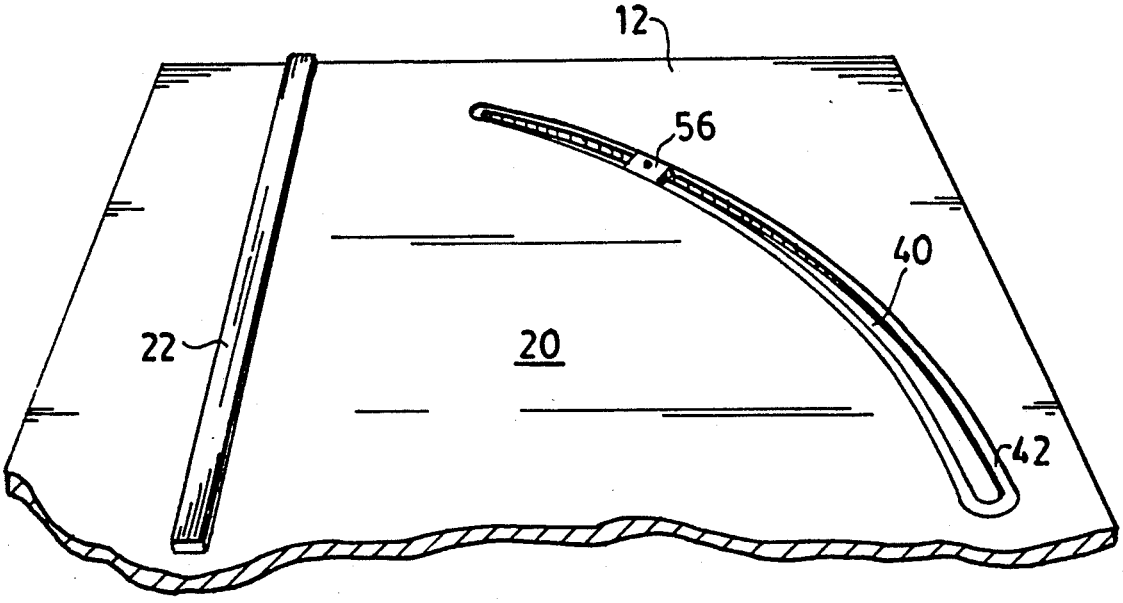
FIG. 2 is a perspective view of a bottom surface of the sliding plate that is shown mounted on the saw table top of FIG. 1.
Figure 3:
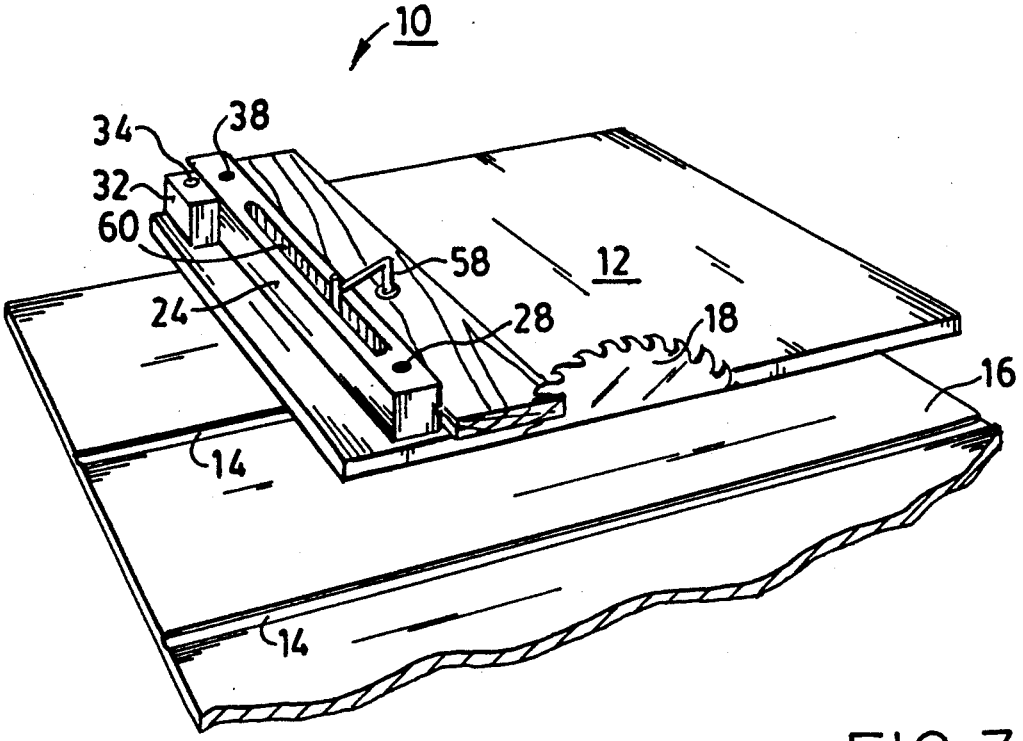
FIG. 3 is a different perspective view of the same novel gauge oriented for making a right angle cut in a work piece with a gauge bar and certain other structures removed to reveal other underlying structures.
Figure 4:
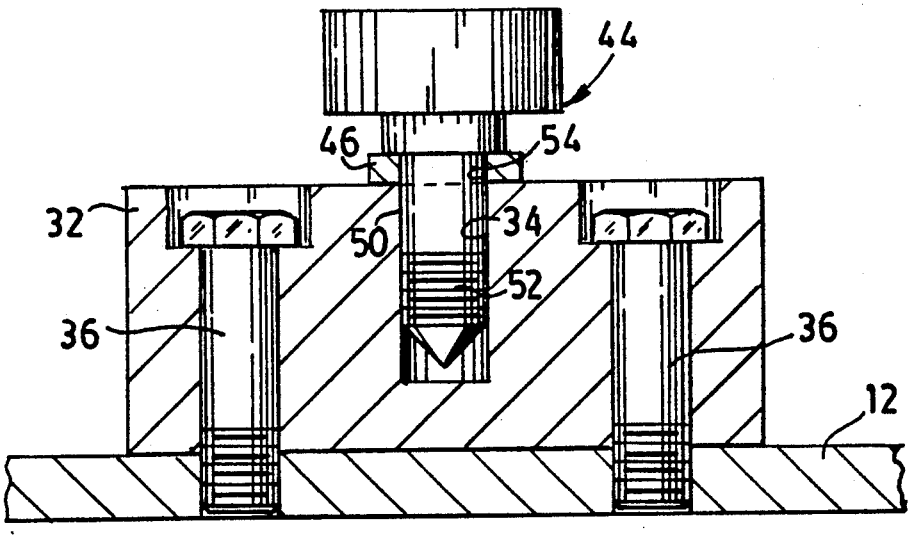
FIG. 4 is an enlarged cross sectional view of the anchor block shown in FIGS. 1 and 3 for securing the gauge bar to the sliding plate.

One embodiment of my mitering gauge is shown in FIGS. 1 through 4. The mitering gauge 10 is assembled on a sliding plate 12 that may be made from a relatively inexpensive laminated particle board. The sliding plate is sized to cover a portion of saw table top 16 on one side of a saw blade 18 that extends through the table top. Attached to bottom surface 20 of sliding plate 12 is guide rail 22 (see FIG. 2) which is accurately sized to fit within a standard miter slot 14. The guide rail permits the sliding plate to move on the table top in a direction that carries a work piece into engagement with the saw blade.

Work piece 30 (shown in FIG. 3) may be oriented on the sliding plate against a fence 24 in a usual manner. The fence is preferably made from an aluminum extrusion forming a true straightedge for orienting the work piece. One end of fence 24 is mounted about pin 26 for varying the orientation of the fence with respect to the feed direction of the sliding plate. The pin 26 is received in an accurately sized bore 28 (see FIG. 3) at the one end of the fence and is threaded into engagement with sliding plate 12.

Another accurately sized bore 38 is formed along the length of fence 24 remote from the bore 28. The bore 38 extends through the fence and is aligned with an arcuate slot 40 formed through sliding plate 12. The arcuate slot is centered about pin 26 so that the bore 38 remains aligned with the slot at varying orientations of the fence. In the bottom surface 20 of sliding plate 12, the arcuate slot is located within a recess 42.

A third accurately sized bore 34 completing the three vertices of a triangle is formed in anchor block 32. Bolts 36 secure anchor block 32 to sliding plate 12. The anchor block is positioned on the plate so that when fence 24 is returned to a resting position against the anchor block (see FIG. 3), the fence extends exactly perpendicular to guide rail 22. The fence may be secured to the sliding plate against anchor block 32 with clamp screw 48.

However, all other predetermined orientations of the fence are set by gauge bar 46. The clamp screw 48 together with clamp screw 44 are used to attach the gauge bar to the anchor block and fence, respectively. Gauge bar 46 includes a number of holes 54 which are accurately spaced in predetermined positions along its length. The holes 54 are also accurately sized to receive locating pin portions of the clamp screws. For example, in the enlarged view of FIG. 4, clamp screw 44 is shown having a portion of its length defined as a locating pin 50 which is sized to fit snugly within both bore 34 of the anchor block and one of the holes 54 of the gauge bar. A threaded portion 52 of the clamp screw engages a similarly threaded portion of bore 34 and provides for securing the gauge bar to the anchor block.

Clamp screw 48 includes a similar gauge pin portion (not shown) which is sized to fit snugly within both bore 38 in the fence and one of the holes 54 located at one end of the gauge bar. However, instead of threading clamp screw 48 into the fence, an extended length of clamp screw 48 engages a threaded block 56 which travels within the recess 42 formed in the bottom surface of the sliding plate. Thus, when clamp screw 48 is tightened, both the gauge bar and fence are clamped to the sliding plate.

Although gauge bar 46 is illustrated with an adjustable portion of its length secured to anchor block 32, it may be appreciated that the same distance between bores 34 and 38 may be established by connecting opposite ends of the bar to the anchor block and fence. Once one or the other orientation of the fence is selected, the holes in the gauge bar may be marked to identify corresponding angular settings of the fence. In addition, although separate locating pin portions are used to align holes in the gauge bar with bores formed in the fence and anchor block, it would be possible to replace one or the other of the holes and bores with locating pins. The various combinations of pins or holes and pins or bores which may be used to attach the gauge bar may be referred to as pin-hole arrangements and pin-bore arrangements, respectively.

Other features of the first embodiment include a slot 60 is formed along the top of the fence to support a clamp 58 in positions along the length of the fence. The clamp, shown only schematically in FIG. 1, may be constructed in a usual manner to provide for securing work pieces to the sliding table. An adjustable end block 62 may also be used to set a predetermined length of work piece to be cut. A clamp screw 64 is used to tighten the end block to the fence.

Figure 5:
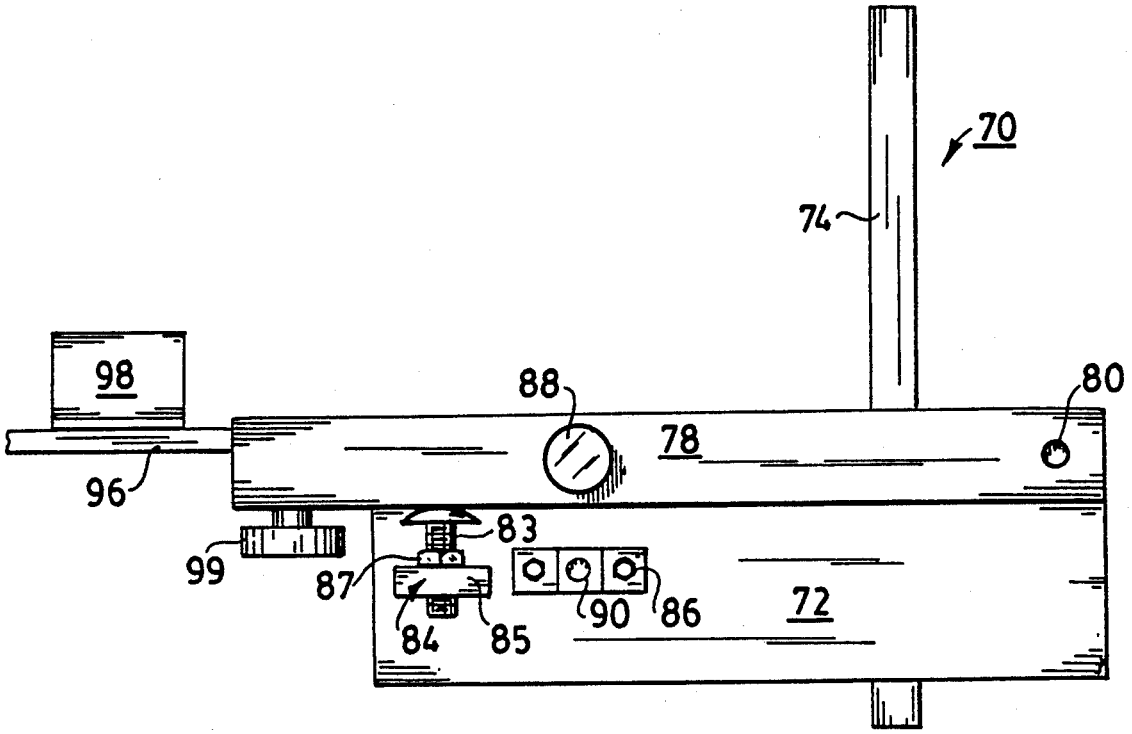
FIG. 5 is a plan view of an alternative embodiment of my invention also arranged for making a right angle cut.
Figure 6:
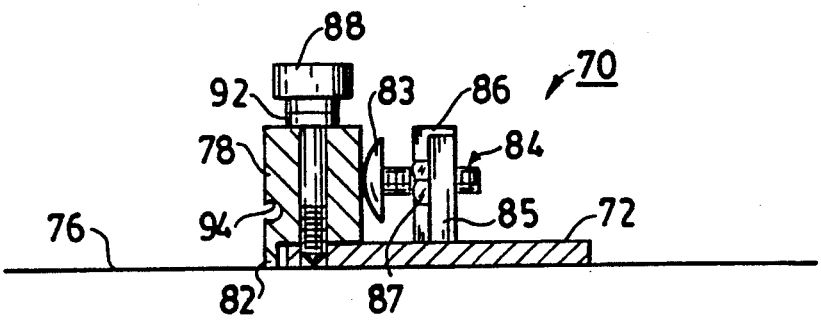
FIG. 6 is a cross sectional end view of the alternative mitering gauge mounted on the saw table top.

FIGS. 5 and 6 illustrate an alternative mitering gauge 70 in accordance with a second embodiment of my invention. The gauge includes a sliding plate 72 which is attached to guide rail 74. The plate 72 is much smaller than the plate 12 of the preceding embodiment and does not provide for supporting a work piece. Instead, a work piece (not shown) is positioned directly on saw table top 76 against fence 78. Preferably, the sliding plate 72 is constructed of a metal plate so that the plate can be rigidly secured to a limited portion of the length of the guide rail.

Fence 78 is mounted about pin 80 for varying the orientation of the fence with respect to guide rail 74. A lip portion 82 of fence 78 rests on table top 76 and the remaining portion of the bottom surface of the fence is cut away to provide clearance for sliding plate 72.

An adjustable stop 84 is used independently of anchor block 86 to restrict angular movement of fence 78. The stop is adjustable to align the fence in a rest position exactly perpendicular to the guide rail. The adjustment is made by turning stove bolt 83 that is secured in place to a base 85 of the stop by nut 87. The base 85 is attached to the plate 72 by conventional means. Clamp screw 88 threadably engages a bore formed in sliding plate 72 to secure the fence to the plate in the rest position.

Although not shown, it is intended that a gauge bar similar to gauge bar 46 of the preceding embodiment may be used to connect fence 78 to anchor block 86 at distances corresponding to desired angular orientations of the fence. A clamp screw (also not shown) would be used to align a selected hole in the gauge bar with bore 90 of anchor block 86. The other end of the gauge bar would be secured to fence 78 by clamp screw 88. However, in the illustrated rest position, it is important to note that a washer 92 is used as a spacer in place of the gauge bar to preserve a small clearance between clamp screw 88 and saw table top 76.

A view of channel 94 which runs along the length of the front face of fence 78 is provided by FIG. 6. The channel supports a sliding bar 96 to which end block 98 is attached. Thumb screw 99 is used to tighten the sliding bar to the fence at a desired position of the end block along the length of fence 78.

Figure 7:
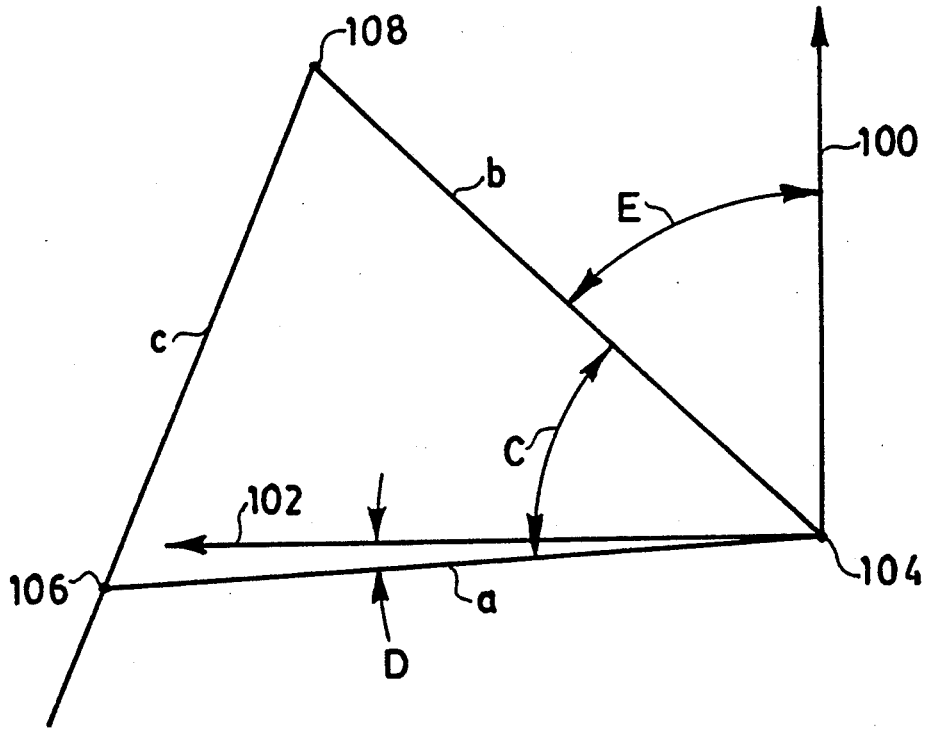
FIG. 7 is a geometric construction from which appropriate lengths of the gauge bar may be calculated.

Both of the above-described embodiments may be understood to include respective structures which define three legs of a triangle. Such a triangle is depicted in FIG. 7 having legs a, b, and c oriented with respect to orthogonal arrows 100 and 102. The arrow 100 indicates the feed direction of a woodworking machine.

Consider, for example, with respect to the first embodiment, a first vertex 104 of the triangle is defined as a pivot axis by mounting pin 26 together with bore 28 formed in one end of fence 24. A second vertex 106 is defined by bore 34 formed in the anchor block together with the locating pin portion of clamp screw 44. Leg a of the triangle is defined at a fixed length between vertices 104 and 106 and at a fixed orientation to feed direction 100. A third vertex 108 is defined along the length of fence 24 by bore 38 together with the locating pin portion of clamp screw 48. Leg b of the triangle is defined at a fixed length between vertices 104 and 108. Finally, leg c, which is adjustable in length, is defined between vertices 106 and 108. One of the holes 54 in gauge bar 46 is aligned with bore 38 by the pin portion of clamp screw 48, and the length of leg c is controlled by aligning another of the holes 54 in the gauge bar with the bore 34 of the anchor block using the pin portion of clamp screw 44.

It may be noted that leg a is angularly disposed to orthogonal arrow 102 through angle D. The angle D is formed by offsetting anchor block 32 with respect to arrow 102 so that fence 24 is aligned with arrow 102 when pivoted into contact with the anchor block. Also, it is preferred that the length of leg b is defined as the product of the length of leg a and the Cosine function of angle D. This feature provides for aligning bores 34 and 38 in the direction of arrow 100 when the fence is aligned with orthogonal arrow 102.

In accordance with my invention, the length of side c is adjusted to orient fence 24 with respect to feed direction 100 at one of a number of predetermined angles E. According to the Law of Cosines and with the lengths of three legs of a triangle being known, an angle C between two of the sides a and b may be determined. The holes 54 are spaced along the gauge bar so that the complement of angle C added together with the fixed angle D is equal to predetermined angles E. Preferably, the range of angles that may be set by varying lengths of leg c extends between thirty and ninety degrees; and therebetween, the holes are spaced to form miter joints corresponding to a range of between three and twelve sided geometric figures.

Although my invention has only been described with respect to its preferred embodiments, it may be appreciated that many other variations consistent with the teaching of my invention will be apparent to those of skill in the art. For example, although my novel mitering gauge has only been shown as an attachment to a table saw, it is contemplated that my mitering gauge may also be used with other woodworking machines including radial arm saws, chop saws, and shapers. In fact, it is contemplated that my invention will be useful with other types of machines for working such materials as plastics which must also be oriented to predetermined angles with respect to a cutting tool.

I claim:

1. A mitering gauge for making miter joints in work pieces comprising:

a sliding plate having a guide rail attached to its bottom surface for sliding within a miter slot of a machine table;

a fence for aligning a work piece with respect to said guide rail, one end of said fence is mounted on said sliding plate about a pivot pin, and a first pin-bore is formed along a length of said fence remote from said pivot pin;

an anchor block mounted on said sliding plate having a second pin-bore formed therein; said pivot pin and said second pin bore are aligned in a fixed angular orientation to said guide rail;

a gauge bar having a first pin-hole formed at one end region and a series of pin-holes spaced from said first pin-hole; and means for aligning said first pin-hole with one of said first and second pin-bores and for aligning one of said series of pin-holes with the other of said first and second pin-bores, wherein said series of pin-holes are accurately spaced from said first pin-hole by distances corresponding to predetermined angular orientations of said fence with respect to said guide rail.

2. The mitering gauge of claim 1 wherein said aligning means includes a first clamp screw having a portion of its length formed as a locating pin that aligns one of said pin-holes in the gauge bar with said second pin-bore formed in the anchor block.

3. The mitering gauge of claim 2 wherein said aligning means also includes a second clamp screw having a portion of its length formed as a locating pin that aligns another of said pin-holes in the gauge bar with said first pin-bore formed along the length of the fence.

4. The mitering gauge of claim 3 wherein said first clamp screw also includes a threaded portion for engaging a similarly threaded portion of said second pin-bore formed in the anchor block for securing said gauge bar to said anchor block.

5. The mitering gauge of claim 4 wherein an arcuate slot is formed in said sliding plate, and said arcuate slot is centered about said pivot pin and is aligned with said first pin-bore formed in the fence.

6. The mitering gauge of claim 5 further comprising a threaded block that travels within a recess formed about said arcuate slot in said bottom surface of the sliding plate, and wherein said second clamp screw includes a threaded portion for engaging said threaded block and for clamping said gauge bar and said fence to said sliding plate.

7. The mitering gauge of claim 4 wherein said anchor block is offset with respect to a line perpendicular to said guide rail passing through said pivot pin by an amount that provides for orienting said fence along said line when said fence is positioned in contact with said anchor block.

8. The mitering gauge of claim 4 further comprising an adjustable stop that provides for orienting said fence along a line perpendicular to said guide rail when said fence is positioned in contact with said stop.

9. A mitering gauge for making a plurality of predetermined angular cuts in work pieces comprising:

three legs joined by vertices defining a triangle;

a first of said legs is defined in a sliding plate having a guide rail attached to its bottom surface; said first leg is further defined at a fixed length and at a fixed orientation through a first angle (D) with respect to a line perpendicular to said guide rail;

a second of said legs is defined in a fence for orienting a work piece with respect to said guide rail; said second leg is further defined at a fixed length and at a variable orientation to said first leg through second angles (C); and a third of said legs is defined in a gauge bar for connecting said first and second legs at respective vertices opposite to said second angles (C); said third leg having a series of pin holes that can be selectively pinned to one of said first or second legs for orienting said second leg at predetermined third angles (E) with respect to said guide rail, wherein said third angels (E) are defined by the complement of said angles (C) added to said first angle (D).

10. The mitering gauge of claim 9 wherein said predetermined lengths of the gauge bar provide for varying said second angles (C) by amounts that define said third angles (E) corresponding to frequently used mitering angles.

11. The mitering gauge of claim 10 wherein said third angles (E) span a range of between thirty and ninety degrees.

12. The mitering gauge of claim 11 wherein said third angles (E) provide for making miter joints corresponding to a range of between three and twelve sided geometric figures.

13. The metering gauge of claim 10 wherein said fixed length of the second leg is equal to the product of said fixed length of the first leg and a Cosine function of said first angle (D).

14. A metering gauge for making miter cuts in work pieces comprising:

three legs of a triangle connected at three vertices, two of said legs having fixed lengths and a third leg having an adjustable length;

one of said fixed length legs is defined in a plate that is mountable on a machine table top for relative movement in a feed direction;

the other of said fixed length legs is defined in a fence for orienting work pieces with respect to the feed direction, and one end of said fence is mounted about a pivot axis that is located in a fixed position on said plate;

said adjustable length leg is defined in a gauge bar having a first pin-hole and a series of pin-holes that are spaced at predetermined distances from said first pin-hole along the length of said gauge bar;

a first of said vertices is defined by said pivot axis and interconnects one end of each of said two fixed length legs;

a second of said vertices is aligned with one of said first pin-hole and said series of pin-holes in the gauge bar and interconnects the other end of said one fixed length leg with said adjustable length leg;

a third of said vertices is aligned with the one of the other of said first pin-hole and said series of pin-holes in the gauge bar and interconnects the other end of said other fixed length leg with said adjustable length leg;

said first and second vertices define between them a first length (a) of said one fixed length leg in a fixed angular orientation to the feed direction through a fixed first angle (D) measured between said one fixed length leg and a line perpendicular to the feed direction;

said first and third vertices define between them a second length (b) of said other fixed length leg in a variable orientation to the feed direction through a variable second angle (E) measured between said other fixed length leg and the feed direction;

said second and third vertices define between them a series of different third lengths (c) of said adjustable length leg in a variable orientation to the feed direction;

said different third lengths (c) of the adjustable length leg together with said respective first and second lengths (a and b) of the two fixed length legs define a variable third angle (C) measured between said two fixed length legs; and said fence is adjustable to predetermined angular amounts with respect to the feed direction through said variable second angle (E) corresponding to said different third lengths (c) of the adjustable length leg by aligning different pin-holes of said series of pin-holes in the gauge bar with one of said second and third vertices.

15. The metering gauge of claim 14 wherein said variable second angle (E) is determined by the complement of said variable third angle (C) added to said fixed first angle (D).

16. The metering gauge of claim 15 wherein said series of pin-holes in the gauge bar are spaced at predetermined intervals from said first pin-hole by amounts that define a plurality of predetermined amounts of said variable second angle (E) corresponding to frequently used metering angles.

17. The metering gauge of claim 16 wherein said series of pin-holes are spaced in the gauge bar at intervals that define predetermined amounts of said variable second angle (E) throughout a range of between thirty and ninety degrees.

18. The metering gauge of claim 17 wherein said predetermined amounts of said variable second angle (E) provide for making miter joints corresponding to a range of between three and twelve sided geometric figures.

19. The metering gauge of claim 15 wherein said second length (b) of the other fixed length leg is is equal to the product of said first length (a) of the one fixed length leg and a Cosine function of said fixed first angle (D).

20. The metering gauge of claim 15 wherein said pivot axis is further defined by a mounting pin that is received in a similarly sized bore formed in said one end of the fence.

21. The metering gauge of claim 15 further comprising an anchor block mounted on said plate and having a pin-bore formed therein defining said second vertex.

22. The metering gauge of claim 21 wherein said second vertex is further defined by a first clamp screw having a portion of its length formed as a locating pin that aligns one of said pin-holes in the gauge bar with said pin-bore formed in the anchor block.

23. The metering gauge of claim 22 wherein said third vertex is defined by a pin-bore formed in said fence.

24. The metering gauge of claim 11 wherein said third vertex is further defined by a second clamp screw also having a locating pin portion for aligning another of said pin-holes in the gauge bar with said pin-bore formed in the fence.

25. The metering gauge of claim 20 wherein a bottom surface of said plate includes an attached guide rail that is sized to fit within a similarly sized miter slot formed in the table top.

26. The metering gauge of claim 25 wherein an arcuate slot is formed through said plate, and said arcuate slot is centered about said mounting pin and is aligned with a pin-bore arrangement formed in said fence.

27. The metering gauge of claim 26 further comprising a threaded block that travels within a recess formed about said arcuate slot in said bottom surface of the plate, and a clamp screw including a threaded portion for engaging said threaded block and for clamping said gauge bar and said fence to said plate.

28. The metering gauge of claim 22 wherein said first clamp screw also includes a threaded portion for engaging a similarly threaded portion of said pin-bore formed in the anchor block for securing said gauge bar to said anchor block.

29. The metering gauge of claim 28 wherein said anchor block is offset with respect to said line perpendicular to the feed direction by an amount that provides for orienting said fence along said line when said fence is positioned in contact with said anchor block.

30. The metering gauge of claim 28 further comprising an adjustable stop that provides for orienting said fence along said line perpendicular to the feed direction when said fence is positioned in contact with said stop.

* * * * *